US005952624A

United States Patent [19]

Hornback et al.

[11] Patent Number: 5,952,624

[45] Date of Patent: Sep. 14, 1999

[54] NOISE ATTENUATOR

[75] Inventors: Jerry Brian Hornback, Franklin, Ind.; Jose' Eduardo Lapore, Cambui, Brazil

[73] Assignee: Arvin Industries, Inc., Columbus, Ind.

[21] Appl. No.: 08/846,735

[22] Filed: Apr. 30, 1997

[51] Int. Cl.[6] ..... F01N 1/00

[52] U.S. Cl. ..... 181/255; 181/264; 181/269

[58] Field of Search ..... 181/249, 250, 181/251, 255, 257, 264, 269

[56] References Cited

U.S. PATENT DOCUMENTS

| | | | |
|---|---|---|---|
| 2,984,315 | 5/1961 | Kleinecke | 181/255 |
| 3,578,107 | 5/1971 | Everett | 181/255 |
| 3,958,660 | 5/1976 | Boor | 181/255 |
| 4,109,753 | 8/1978 | Lyman | 181/264 |
| 4,129,196 | 12/1978 | Everett | 181/255 |
| 4,396,090 | 8/1983 | Wolfhugel . | |
| 4,467,887 | 8/1984 | Vizard . | |
| 5,413,189 | 5/1995 | Browning et al. . | |

OTHER PUBLICATIONS

Four (4) color photographs of a muffler part No. FO–4 from Stanley Muffler Co., Inc., West Hwy. 80, East Prairie, Missouri 63845.

*Primary Examiner*—Khanh Dang
*Attorney, Agent, or Firm*—Barnes & Thornburg

[57] ABSTRACT

A noise attenuation system is provided for attenuating noise in exhaust product flowing through an exhaust system. The noise attenuation system includes a tube and an acoustic reflector attached to the tube. The tube includes an inlet end, an outlet end, and an inner surface defining a passageway through which the exhaust product flows. The acoustic reflector includes a tab extending across the passageway. The tab includes a first surface that is convex and faces toward the inlet end of the tube and a second surface that is concave and faces toward the outlet end of the tube.

48 Claims, 4 Drawing Sheets

NOISE ATTENUATOR

BACKGROUND AND SUMMARY OF THE INVENTION

The present invention relates to attenuation of noise in gas flowing through tubes, and in particular to attenuation of specific frequency bands of noise. More particularly, the present invention relates to attenuation of specific frequency bands of noise in engine exhaust gas flowing through a tube while minimizing back pressure effects from the noise attenuation system.

Internal combustion engines typically include an exhaust manifold that collects exhaust gas from engine cylinders and channels it into an exhaust pipe or tube. The exhaust gas flowing into the tube carries engine noise. Factors such as engine type and the range of pressures, temperatures, and velocities of the exhaust gas traveling through the tube affect the characteristics of the noise in the gas, such as amplitude and frequency. Exhaust systems include a muffler system designed to reduce the noise in the exhaust gas over the complete range of audible frequencies for a given engine type. A particular engine type can often produce problem noise frequencies that existing muffler systems do not attenuate effectively.

Methods for addressing problem noise frequencies in exhaust gas flowing through a tube include absorption, dispersion, and cancellation. Absorption reduces noise through use of components that convert acoustic energy to some other form, such as heat. Dispersion reduces problem noises by converting the acoustic energy at one frequency or range of frequencies to other frequencies at which there is no or less of a problem. Cancellation reduces problem noises by reflecting acoustic signals or noise so that the reflected signal negates the noise of acoustic signals traveling in opposing directions. A design constraint for all of these methods in reducing problem noises in engine exhaust is the need to minimize the effect of the noise reduction system on back pressure within the exhaust pipe or tube.

Common methods of addressing problem noise frequencies include addition of a resonator or modifications to either the engine or the muffler to reduce the problem noise. Mufflers, which typically include baffles and tuning volumes for noise reduction, are formed as a separate component from the remainder of the exhaust system. Mufflers invariably include a volume outside of the tube carrying the exhaust gas to aid in noise attenuation. Resonators are also formed as a separate component and similarly employ a separate volume outside the tube to attenuate problem noises. Both mufflers and resonators are installed at appropriate points in the exhaust pipe or tube carrying the exhaust gas from the engine to minimize the effect of back pressure created by the muffler or resonator on engine performance.

According to the present invention, a noise attenuation system is provided for use in attenuating noise in gas flowing through an exhaust system. The noise attenuation system includes a tube having a inlet end, an outlet end, and an inner surface defining a passageway through which the exhaust product flows. The noise attenuation system further includes an acoustic reflector attached to the tube. The acoustic reflector includes a tab that extends across the passageway. The tab includes a surface facing generally obliquely toward the inlet end of the tube. The surface is sized and arranged to occlude less than about fifty percent of a cross-sectional area of the passageway that is perpendicular to a longitudinal axis extending through the passageway.

In preferred embodiments, the acoustic reflector is a tab formed from a thin strip of metal and occludes between about thirty percent and about fifty percent of the cross-sectional area of the passageway. The tube includes an inlet and an outlet, and the acoustic reflector can be coupled across the outlet. The tab includes a central region that can be arcuate or V-shaped, with the central region convex facing the inlet and concave facing the outlet. The acoustic reflector in another embodiment includes two tabs arranged in a cross-shaped configuration across the tube outlet. The two tabs are arcuate, convex facing the inlet and concave facing the outlet, and together occlude less than about fifty percent of the cross-sectional area of the passageway.

In other embodiments, a noise attenuation system includes a muffler having a housing and an inlet coupled to a tuning tube within the muffler housing. An acoustic reflector is coupled across the outlet of the tuning tube. In still other embodimens, a noise attenuation system includes a catalytic converter housing having an inlet, and a tube including an acoustic reflector is coupled to the inlet of the catalytic converter housing.

A method of attenuating noise in gas flowing through an exhaust system tube in accordance with the present invention includes the steps of providing a tube including a passageway, an inlet end, and an outlet end, and providing a tab including a first end, a second end, a central region, a first surface, and a second surface. The tab is coupled to the tube so that the tab occludes between less than about fifty percent of the cross-sectional area of the passageway. The step of providing a tab includes providing a tab formed from a thin metal strip. The tube has an edge defining an opening to the passageway, and the step of coupling the tab to the tube includes coupling the first and second ends of the tab to spaced-apart locations on the edge. The step of providing a tab includes providing a tab with a convex surface or V-shaped surface. The step of providing a tube includes providing a tuning tube within a muffler or a manifold tube for coupling to an inlet of a catalytic converter.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
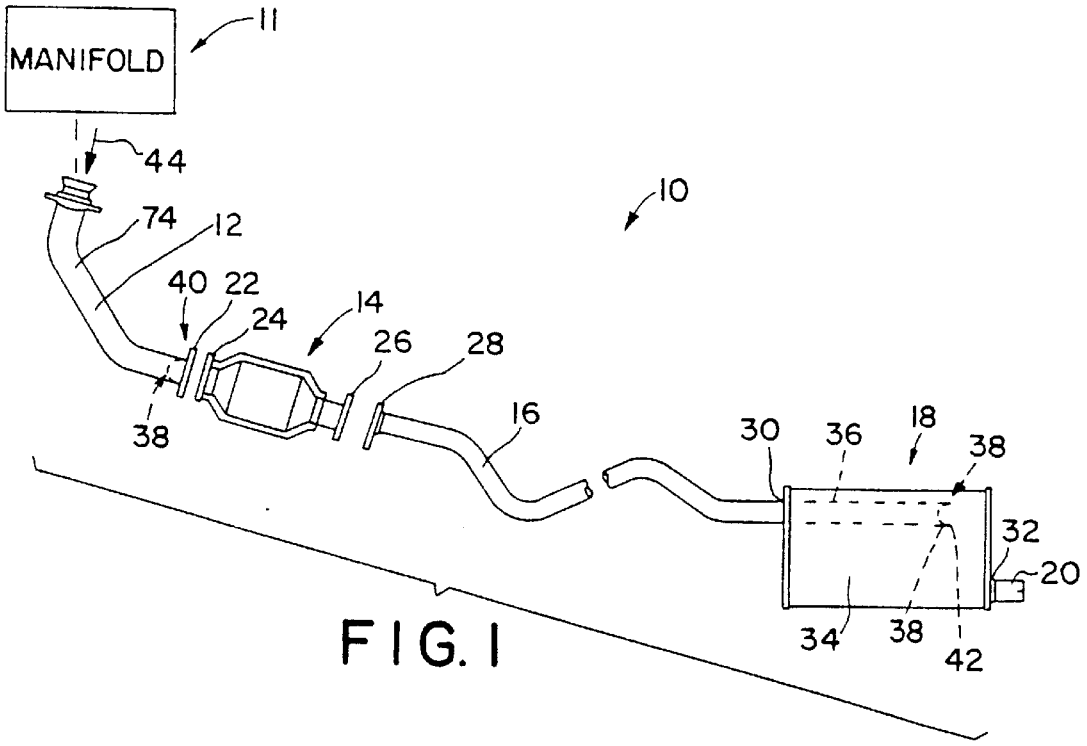
FIG. 1 is a schematic diagram of a vehicle engine exhaust system coupled to the exhaust manifold and the tail pipe, including a catalytic converter and a muffler, showing exemplary locations for placement of noise attenuators according to the present invention within the exhaust system and the location for measurements of back pressure for experimental testing.

An engine exhaust system 10 takes exhaust from an engine exhaust manifold 11 and channels it through a series of tubes and exhaust system components as shown, for example, in FIG. 1. A manifold exhaust tube 12 couples the engine exhaust manifold 11 to a catalytic converter 14 that then connects via another tube 16 to a muffler 18. Finally, a third tube 20, or tailpipe, channels the exhaust output from muffler 18 to the atmosphere.

Tubes 12, 16, and 20 are shaped with various bends and lengths to accommodate the physical configuration of a vehicle (not shown). The catalytic converter 14 and muffler 18 are standard components designed for a variety of vehicle configurations. If a particular engine type generates problem noises in the exhaust system 10 not suitably attenuated by standard exhaust system components, the exhaust system designer traditionally must add an additional noise attenuation device, such as a resonator (not shown). Adding an exhaust system component such as a resonator complicates exhaust system 10 by requiring splitting one of the tubes 12, 14 to accommodate the added component, resulting in increased system complexity and cost.

Catalytic converter 14 includes an inlet bracket or flange 24 and an outlet bracket or flange 26. Manifold tube 12 includes a converter bracket or flange 22 and tube 16 includes a converter bracket or flange 28. Exhaust system 10 is assembled by connecting converter 14 to manifold tube 12 with mating brackets or flanges 22, 24 and to tube 16 with mating brackets or flanges 26, 28. The paired brackets 22, 24, 26, 28 are bolted together to allow for replacement of converter 14.

Muffler 18 includes an inlet 30, outlet 32, and housing 34. Tube 16 also couples to muffler 18 at muffler inlet 30, and tailpipe 20 couples to muffler 18 at muffler outlet 32. Muffler 18 further includes a tuning tube 36 having an inlet end (not shown) and an outlet end 42 within housing 34 as shown in FIGS. 1 and 2.

A noise attenuator 38 according to the present invention can be installed at various locations within the exhaust system 10 without requiring modifications to any of the tubes 12, 16, and 20, converter 14, or muffler 18. Attenuator 38 can be coupled to outlet end 40 of manifold tube 12 adjacent bracket 22, as shown in FIG. 1, or adjacent outlet end 42 of tuning tube 36 inside muffler housing 34 as shown in FIGS. 1 and 2. Both of these locations have been experimentally determined to be effective for reducing noise in the one to ten kilohertz frequency range when using attenuator embodiments according to FIGS. 3*a*–*b* and 5*a*–*b*.

Figure 2:
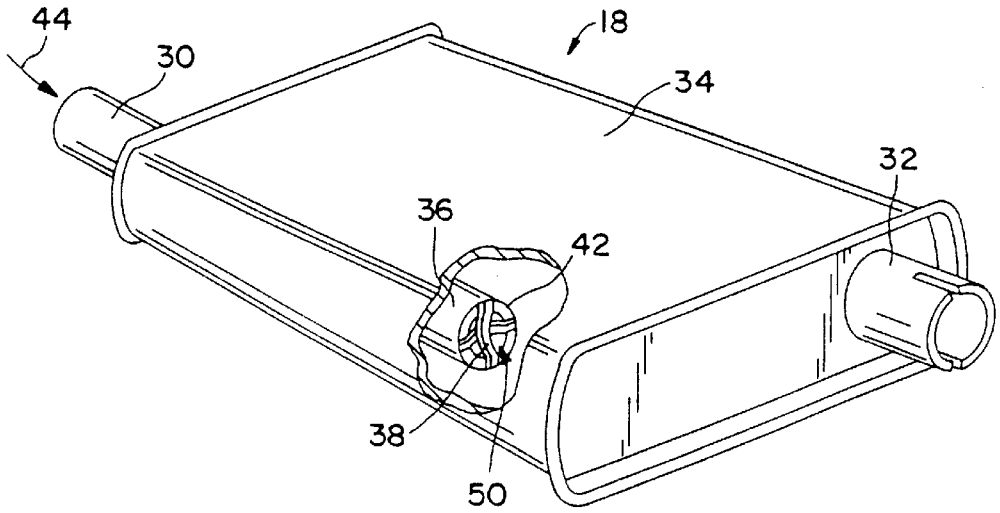
FIG. 2 is a perspective view of a muffler including a muffler body, an inlet tube, an outlet tube, and a tuning tube inside the muffler body, the tuning tube including an edge defining an opening, the muffler body having a portion cut away to show a noise attenuator in accordance with the present invention comprising a cross-shaped acoustic reflector extending across the opening of the tuning tube.
Figure 3B:
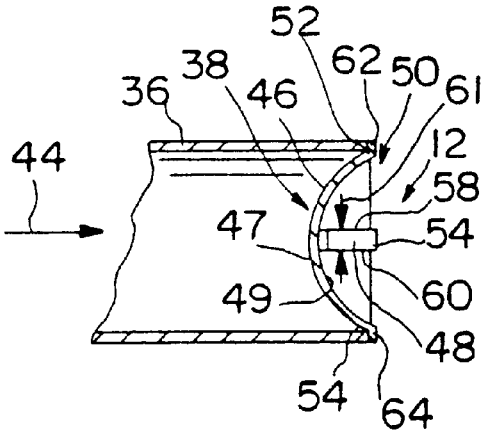
FIG. 3*b* is a longitudinal sectional view taken along line 3*b*—3*b* of FIG. 3*a* showing the arcuate shape of the cross-shaped acoustic reflector.
Figure 3A:
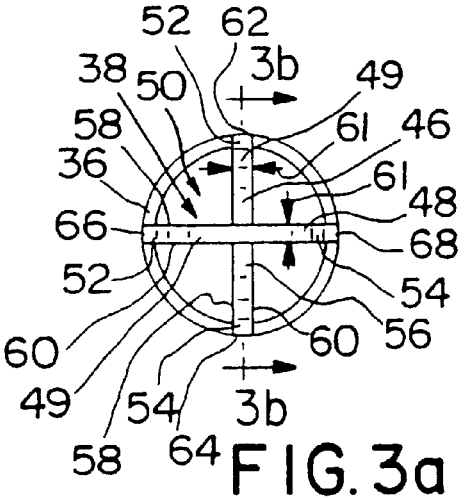
FIG. 3*a* is an end view of the tube of FIG. 2 showing the cross-shaped acoustic reflector including two strips attached at four locations across the opening of the tube.

The noise attenuator 38 of FIGS. 3*a*–*b* is attached to outlet end 42 of tuning tube 36 inside muffler housing 34 as shown in FIG. 2. Engine exhaust flows in direction 44 into muffler 18 through muffler inlet 30 and exits through muffler outlet 32. When engine exhaust passes through muffler 18, it travels from the inlet end (not shown) of tuning tube 36 to outlet end 42 of tuning tube 36. Noise attenuator 38 includes two strips 46, 48 arranged in a cross-shaped pattern and attached across opening 50 at the outlet end 42 of tuning tube 36 as best shown in FIGS. 3*a*–*b*. Each strip has a first end 52, or peripheral portion, and a second end 54, or peripheral portion, connected by a central region 56, or central portion, that has generally parallel edges 58, 60 spaced apart by a distance 61. First strip 46 is attached to outlet end 42 at diagonally opposite top and bottom locations 62, 64 and second strip 48 is attached at diagonally opposite side locations 66, 68 spaced about ninety degrees apart from locations 62, 64. Each strip has a midpoint 53, and the strips 46, 48 are coupled together at their midpoints. Experimental results have determined that a distance 61 of about 0.36 in. (0.80 cm) for a tuning tube 36 having an inside diameter of 1.75 in. (3.85 cm) effectively attenuates problem noises between one and ten kilohertz while limiting upstream back pressure increases to less than five percent for a four cylinder engine.

Strips 46, 48 are formed with a generally arcuate profile that is convex in the direction 44 of exhaust flow in tuning tube 36 as shown in FIG. 3*b*. Each strip 46, 48 has a first surface 47 and a second surface 49. First surface 47 is convex in a direction facing away from outlet end 42 and second surface 49 is concave in an opposite direction facing toward outlet end 42. By presenting a strip surface that is generally oblique with respect to the direction 44 of exhaust flow, the convex shape of strips 46, 48 makes noise attenuator 38 "flow friendly," that is, noise attenuator 38 presents an obstruction to reflect noise back up tuning tube 36 while minimizing the effect on back pressure in comparison to flat strips (not shown) connected between top and bottom locations 62, 64 and side locations 66, 68 across opening 50. By forming strips 46, 48 with a "flow friendly" shape, the noise attenuator 38 of FIGS. 2–3*b* occludes about 48 percent of the cross-sectional area of tuning tube opening 50 as seen looking in the direction 44 of exhaust flow while resulting in an experimentally measured back pressure increase of less than five percent for a typical four cylinder engine.

Figure 4:
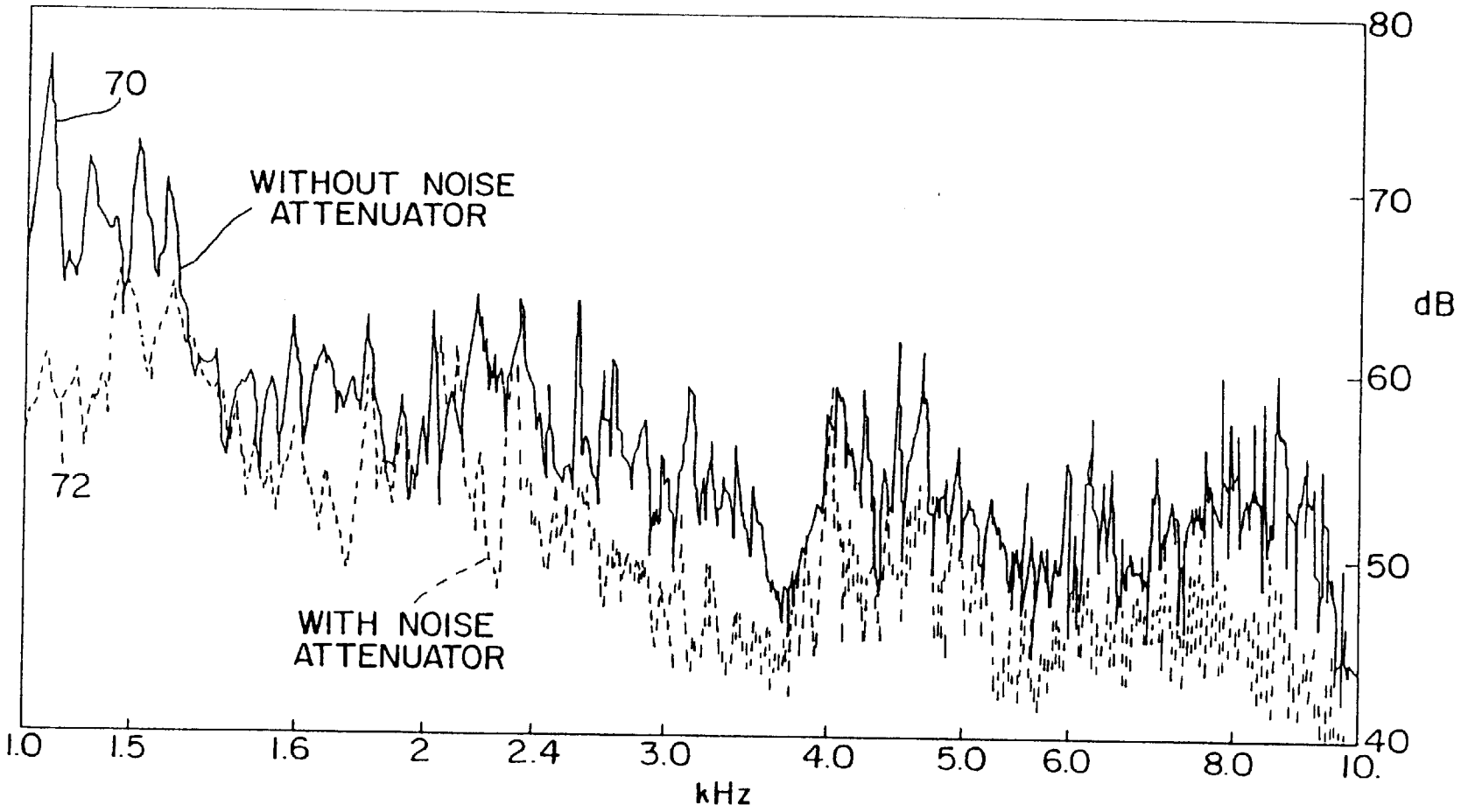
FIG. 4 is an acoustic graph showing experimentally measured noise levels across a frequency range of about one to ten kilohertz for a manifold tube adjacent a catalytic converter with (solid line) and without (dashed line) the noise attenuator of FIGS. 2–3*b;*

Experimentally measured results for a four cylinder engine that exhibited problem noise are shown in FIG. 4. In the frequency range from about one to about ten kilohertz, as shown by the solid line.70, the problem noise was not suitably attenuated by muffler 18. Installation of noise attenuator 38 of FIGS. 3*a–b* at outlet end 40 of manifold tube 12 as shown in FIG. 1 resulted in reduced noise, measured just downstream of noise attenuator 38, as shown by dashed line 72. Pressure in tuning tube 12 was measured at location 74 to verify that noise attenuator 38 did not cause more than a five percent increase in back pressure in tuning tube 12. As shown by the graph of FIG. 4, noise attenuator 38 caused a general decrease in noise levels across the entire problem noise frequency range from about one to ten kilohertz. Statistical averaging of the measured data showed that the average noise reduction over this range was about 5.5 decibels.

Thus, as shown in FIGS. 1–3*b* and according to the experimental results in FIG. 4, noise attenuator 38 of the present invention can be used in an existing exhaust system 10 to attenuate problem noises without costly redesign of the muffler or addition of components, such as a resonator, that require modifications to the existing tubes. By adding noise attenuator 38 to manifold tube 12, standard exhaust system 10 connected to a four cylinder engine can be adapted to a system experiencing problem noise levels between about fifty to eighty decibels between about one to ten kilohertz.

Noise attenuators in accordance with the present invention can be installed anywhere within a tube, such as manifold tube 12, exhaust tube 16, or tuning tube 36. Adjusting the size, number, shape, position, and orientation of the acoustic reflector(s) within a tube can optimize the attenuation of specific problem noise frequencies. FIGS. 5*a–*8*c* illustrate several such variations of noise attenuator configurations.

Noise attenuators in accordance with the present invention can be formed either by adding strips formed from metal or other suitable material to a tube as shown in FIGS. 3*a–b* and 5*a–*8*c*. Adding a noise attenuator in accordance with the present invention to the tube provides a mechanism for attenuating problem noises that is simple, low-cost, reliable, and both easy to manufacture and easily incorporated into existing exhaust and muffler systems.

In addition to the arcuate cross-shaped noise attenuator embodiment 38 of FIGS. 3*a–b*, other embodiments of the present invention provide for attenuating problem noise frequency bands by varying the geometry as shown by noise attenuators 138, 238, 338, and 438 in FIGS. 5*a–*8*c*, respectively. A feature common to all embodiments of the present invention is the insertion of a noise attenuator across a passageway through which a flow of exhaust gas travels to reflect sound back up the tube while being "flow friendly," that is, without creating significant back pressure so as to affect upstream engine performance adversely.

Figure 5B:
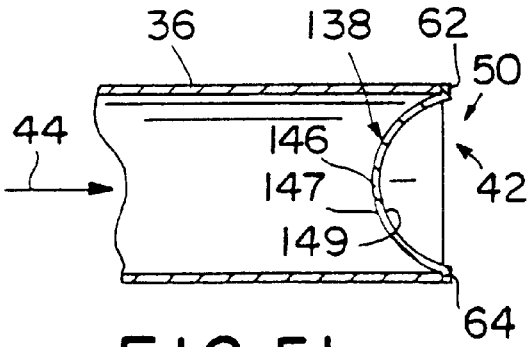
FIG. 5*b* is a longitudinal sectional view, similar to FIG. 3*b*, taken along line 5*b*—5*b* of FIG. 5*a* showing the arcuate cross-sectional shape of the arcuate acoustic reflector of FIG. 5*a;*
Figure 5A:
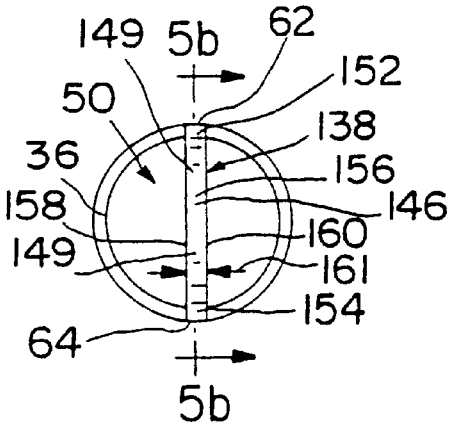
FIG. 5*a* is an end view, similar to FIG. 3*a*, of another preferred embodiment of a noise attenuator of the present invention including an acoustic reflector having a single strip of material connected to a tube.

Referring now to FIGS. 5*a–b*, acoustic reflector 138 includes strip 146 having parallel edges 158, 160 spaced apart by a distance 161, which illustratively is no more than about 0.55 in. (1.2 cm) for a tube 36 with an inside diameter of 1.75 in. (3.85 cm). Noise attenuator 138 has a first end 152, or peripheral portion, attached at top location 62 of tube opening 50 and a second end 154, or peripheral portion, attached at bottom location 64, connected by a central region 156, or central portion. To achieve a "flow friendly" configuration, noise attenuator 138 is further formed with an arcuate shape having a convex profile in the direction of exhaust flow as shown in FIG. 5*b*. Strip 146 has a first surface 147 and a second surface 149. First surface 147 is convex in a direction facing away from outlet end 42 and second surface 149 is concave in an opposite direction facing toward outlet end 42. The cross-sectional area of tube opening 50 occluded by noise attenuator 138 is relatively small enough, illustratively about forty percent, that back pressure generated within tube 36 does not significantly affect performance of the upstream exhaust-generating engine (not shown).

Figure 6B:
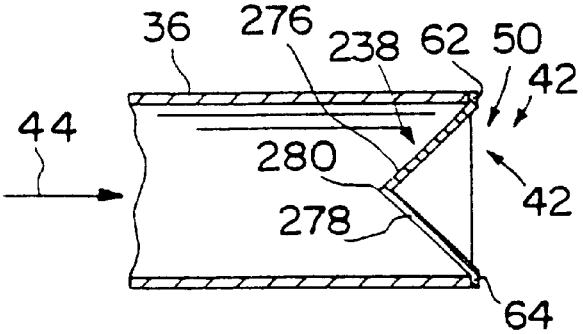
FIG. 6*b* is a longitudinal sectional view, similar to FIG. 3*b*, taken along line 6*b*—6*b* of FIG. 6*a* showing the V-shaped cross-sectional shape of the acoustic reflector of FIG. 6*a;*
Figure 6A:
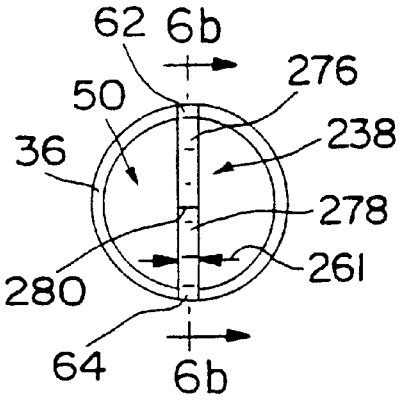
FIG. 6*a* is an end view, similar to FIG. 3*a*, of yet another preferred embodiment of a noise attenuation system including an acoustic reflector having a single strip of material with two ends attached at two locations across the opening of the tube.

Noise attenuator 238 includes first and second segments 276, 278 connected at a ridge 280 as shown in FIGS. 6*a–b*. First segment 276 is coupled to outlet end 42 of tube 36 at top location 62 and second segment is coupled to outlet end 42 at bottom location 64. To achieve a "flow friendly" profile in the direction 44 of exhaust flow, the cross-section of noise attenuator 238 is V-shaped, with its apex at ridge 280 located upstream of locations 62, 64 in the direction 44 of the exhaust flow as shown in FIG. 6*b*. In other words, first and second segments 276, 278 are positioned to lie between ridge 280 and outlet end 42. First and second segments 276, 278 of noise attenuator 238 have a width 261 of no more than about 0.55 in. (1.2 cm) for a tube 36 with an inside diameter of 1.75 in. (3.85 cm), resulting in an occlusion of no more than about forty percent of the cross-sectional area of tube opening 50.

Figure 7B:
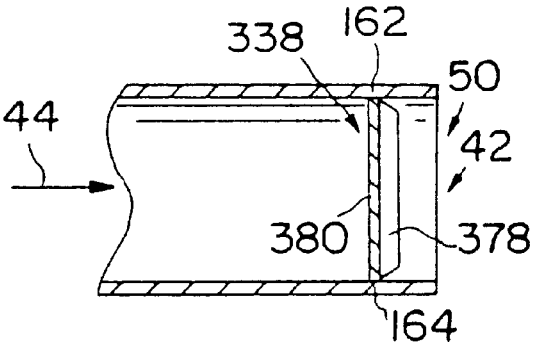
FIG. 7*b* is a longitudinal sectional view, similar to FIG. 3*b*, taken along line 7*b*—7*b* of FIG. 7*a;*
Figure 7A:
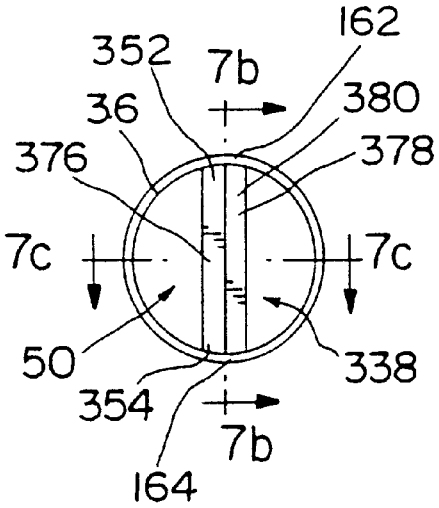
FIG. 7*a* is an end view, similar to FIG. 3*a*, of still another preferred embodiment of a noise attenuation system including an acoustic reflector having a strip of material connected to the tube.
Figure 7C:
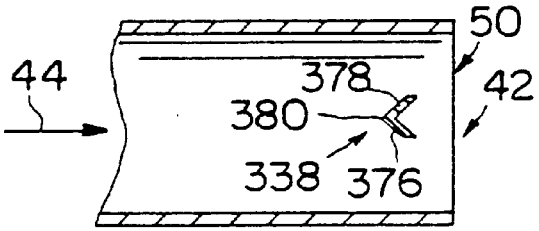
FIG. 7*c* is a lateral sectional view taken along line 7*c*—7*c* of FIG. 7*a* showing the V-shaped cross-sectional shape of the acoustic reflector of FIG. 7*a;*

The noise attenuators 338, 438 of FIGS. 7*a–*8*c* are alternative arcuate and V-shaped embodiments to the noise attenuators 238, 138 of FIGS. 5*a–*6*b*. Noise attenuator 338 of FIGS. 7*a–c* includes first and second ends 352, 354 attached to outlet end 42 at top and bottom locations 162, 164 and first and second segments 376, 378 connected at ridge 380 to form a V-shaped profile as best shown in FIG. 7*c*. To achieve a "flow friendly" profile, ridge 380 is positioned upstream in the direction 44 of exhaust flow in tube 36 from segments 376, 378, that is, first and second segments 376, 378 are positioned to lie between ridge 380 and outlet end 42.

Figure 8B:
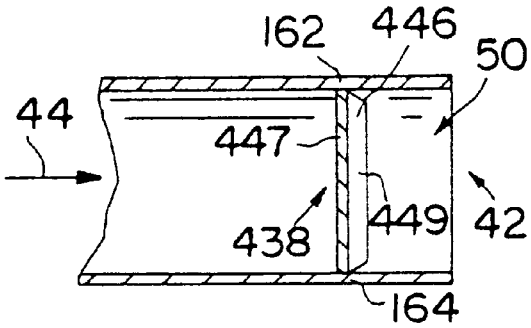
FIG. 8*b* is a longitudinal sectional view, similar to FIG. 3*b*, taken along line 8*b*—8*b* of FIG. 8*a*.
Figure 8A:
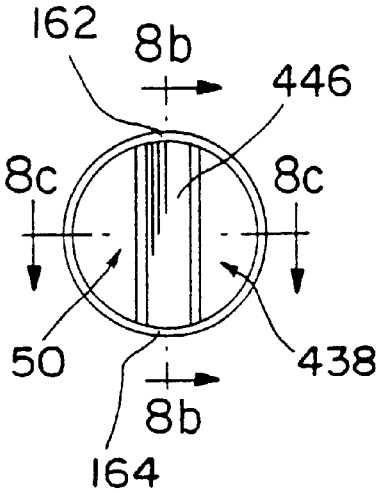
FIG. 8*a* is an end view, similar to FIG. 3*a*, of yet still another preferred embodiment of a noise attenuation system including an acoustic reflector having a strip of material connected to a tube.
Figure 8C:
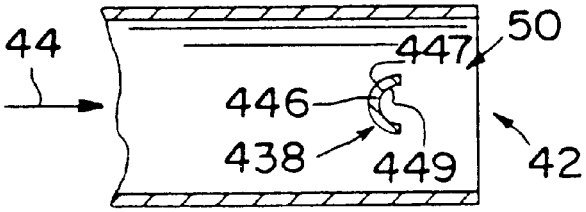
FIG. 8*c* is a lateral sectional view taken along line 8*c*—8*c* of FIG. 8*a* showing the arcuate cross-sectional shape of the acoustic reflector of FIG. 8*a.*

Noise attenuator 438 of FIGS. 8*a–c* has first and second ends 452, 454 attached to outlet end 42 at top and bottom locations 162, 164. Noise attenuator 438 includes a first surface 447 and a second surface 449. To achieve a "flow friendly" configuration, noise attenuator 438 is further formed with an arcuate profile and is convex in the direction 44 of exhaust flow in tube 36 as shown in FIG. 8*c*. In other words, first surface 447 is convex in a direction facing away from outlet end 42 and second surface 449 is concave in an opposite direction facing toward outlet end 42.

Noise attenuators according to the present invention are formed so that turbulent exhaust gas flow is avoided or minimized, i.e., the flow remains substantially laminar. This permits the noise attenuator to reflect sound effectively without creating enough back pressure within the tube to significantly affect upstream engine performance. Different shapes of noise attenuators can attenuate different frequency bands of noise. Optimization of attenuation of specific noise problems can be achieved by varying the size, number, shape, position, and orientation of the noise attenuator(s).

The experimental data for the present invention was collected using a four cylinder engine that was not "turbo-charged" or "super-charged." By varying the cross-sectional area of the exhaust tube occluded by the noise attenuator to prevent adversely affecting upstream engine performance, the present invention can be used to reduce problem noises in any engine exhaust system, such as "turbo-charged" four cylinder engines or an engines with more than four cylinders.

Furthermore, although preferred embodiments of the present invention are formed by adding strips of metal, such as steel, the noise attenuators according to the present invention can be formed from any suitable material, such as other metals or alloys, plastic, or composite material. By placing the acoustic reflector directly into the tube, the noise attenuation system does not require addition of a separate tuning volume outside the tube. Furthermore, the noise attenuation system of the present invention can be incorporated into the existing tubes of standard muffler and exhaust systems.

Although this invention has been described in detail with reference to certain embodiments, variations and modifications exist within the scope and spirit of the invention as described and as defined in the following claims.

We claim:

1. A noise attenuation system for use in attenuating noise in exhaust product flowing through an exhaust system, the noise attenuation system comprising a tube having an inlet end, an outlet end, and an inner surface defining a passageway through which the exhaust product flows, and an acoustic reflector attached to the tube, the acoustic reflector including a tab extending across the passageway, the tab having first and second surfaces, the first surface of the tab being convex and facing toward the inlet end of the tube, and the second surface being concave and facing toward the outlet end of the tube.

2. The noise attenuation system of claim 1, wherein the passageway includes a longitudinal axis and a cross-sectional area perpendicular to the longitudinal axis and the tab occludes between about thirty percent and about fifty percent of the cross-sectional area of the passageway.

3. The noise attenuation system of claim 1, wherein the tab is formed from a thin strip of metal.

4. The noise attenuation system of claim 1, wherein the tube includes an edge defining an opening to the tube, and the tab includes a first end coupled to the edge at a first location, a second end coupled to the edge at a second location spaced apart from the first location, and a central region connecting the first and second ends.

5. The noise attenuation system of claim 4, wherein the central region of the tab is arcuate.

6. The noise attenuation system of claim 1, wherein the passageway includes a longitudinal axis and a cross-sectional area perpendicular to the longitudinal axis, the tab comprises first and second tabs each having a first surface and a second surface, the first surface faces generally obliquely toward the inlet end of the tube, the second surface faces generally toward the outlet end of the tube, and the first and second tabs together occlude less than about fifty percent of the cross-sectional area of the passageway.

7. The noise attenuation system of claim 6, wherein the tube includes an edge defining an opening to the tube, the first tab includes a first end coupled to the edge at a first location, a second end coupled to the edge at a second location spaced apart from the first location, and a central region connecting the first and second ends, the second tab includes a first end coupled to the edge at a third location spaced apart from the first and second locations, a second end coupled to the edge at a fourth location spaced apart from the first, second, and third locations, and a central region connecting the first and second ends.

8. The noise attenuation system of claim 6, wherein the first tab is coupled to the second tab.

9. The noise attenuation system of claim 8, wherein the first tab includes a midpoint, the second tab includes a midpoint, and the midpoint of the first tab is coupled to the midpoint of the second tab.

10. The noise attenuation system of claim 7, wherein of the central regions of the first and second tabs are arcuate.

11. The noise attenuation system of claim 10, wherein the first surfaces of the first and second tabs are convex and face toward the inlet end of the tube and the second surfaces are concave and face toward the outlet end of the tube.

12. The noise attenuation system of claim 1, further comprising a muffler housing formed to include an interior region, a muffler inlet into the interior region, and the inlet end of the tube is coupled to the muffler inlet and positioned to lie in the interior region to cause exhaust product flowing into the interior region through the muffler inlet to pass through the tube to intercept the acoustic reflector positioned to lie therein.

13. The noise attenuation system of claim 1, further comprising a catalytic converter housing formed to include an interior region and a converter inlet into the interior region and wherein the outlet end of the tube is coupled to the converter inlet.

14. The noise attenuation system of claim 1, wherein the passageway includes a longitudinal axis and a cross-sectional area perpendicular to the longitudinal axis and the tab occludes less than about fifty percent of the cross-sectional area of the passageway.

15. A noise attenuator for use in reducing noise in exhaust product flowing through a tube in an exhaust system, the tube having an inlet end, an outlet end, and an inner surface defining a passageway through which exhaust product flows, the passageway having a longitudinal axis and a cross-sectional area perpendicular to the longitudinal axis, the noise attenuator comprising a tab adapted to couple to the tube and extend across the passageway, the tab including a first end, a second end, and a central region between the first and second ends, the first end being adapted to couple to the tube at a first location, the second end being adapted to couple to the tube at a second location spaced apart from the first location, the central region having a first surface facing generally obliquely toward the inlet end, the first surface of the central region of the tab being convex and adapted to face toward the inlet end of the tube, and the second surface of the central region of the tab being concave and adapted to face toward the outlet end of the tube.

16. The noise attenuation system of claim 15, wherein the tab occludes between about thirty percent and about fifty percent of the cross-sectional area of the passageway.

17. The noise attenuator of claim 15, wherein the tab is formed so that at least a portion of the central region is positioned in the passageway between the inlet end of the tube and the first location.

18. The noise attenuator of claim 15, wherein the tube is formed to include an edge that defines an opening to the tube and the tab is adapted to couple to the tube adjacent to the edge.

19. The noise attenuator of claim 15, wherein the central region of the tab is arcuate.

20. The noise attenuator of claim 15, wherein the tab comprises first and second tabs each having a first end, a second end, and a central region between the first and second ends, the first ends are coupled to the tube at first and second locations, the second ends are coupled to the tube at third and fourth locations, the second location is spaced apart from the first location, the third location is spaced apart from the first and second locations, the fourth location is spaced apart from the third location, and wherein the first and second tabs are sized to occlude less than about fifty percent of the cross-sectional area of the passageway.

21. The noise attenuator of claim 20, wherein the tube is formed to include an edge that defines an opening to the tube and the first and second tabs are adapted to couple to the tube adjacent to the edge.

22. The noise attenuator of claim 20, wherein the central region of the first tab is coupled to the central region of the second tab.

23. The noise attenuator of claim 20, wherein the central regions of the first and second tabs are arcuate.

24. The noise attenuator of claim 23, wherein the first surfaces of the central regions of the first and second tab are convex and face toward the inlet end of the tube and the second surfaces are concave and face toward the outlet end of the tube.

25. The noise attenuation system of claim 15, further comprising a muffler housing formed to include an interior region, a muffler inlet into the interior region, and the inlet end of the tube is coupled to the muffler inlet and positioned to lie in the interior region to cause exhaust product flowing into the interior region through the muffler inlet to pass through the tube to intercept the acoustic reflector positioned to lie therein.

26. The noise attenuation system of claim 15, further comprising a catalytic converter housing formed to include an interior region and a converter inlet into the interior region and wherein the outlet end of the tube is coupled to the converter inlet.

27. The noise attenuation system of claim 15, wherein the tab occludes less than about fifty percent of the cross-sectional area of the passageway.

28. A noise attenuator for use in reducing noise in exhaust product flowing through a tube in an exhaust system, the tube having an inlet end, an outlet end, and an inner surface defining a passageway through which exhaust product flows, the passageway having a longitudinal axis and a cross-sectional area perpendicular to the longitudinal axis, the noise attenuator comprising first and second tabs adapted to couple to the tube and extend across the passageway, the first and second tabs each including a first end, a second end, and a central region between the first and second ends, the first end being adapted to couple to the tube at a first location, the second end being adapted to couple to the tube at a second location spaced apart from the first location, the central region having a first surface and a second surface, the first surface facing generally obliquely toward the inlet end of the tube, the first and second tabs being sized to occlude between about thirty percent and about fifty percent of the cross-sectional area of the passageway, and the first tab being coupled to the second tab.

29. The noise attenuation system of claim 28, wherein the tabs occlude between about thirty percent and about fifty percent of the cross-sectional area of the passageway.

30. The noise attenuator of claim 28, wherein each of the plurality of tabs is formed so that at least a portion of the central region is positioned to lie in the passageway between the inlet end and the first location.

31. The noise attenuator of claim 28, wherein the outlet end of the tube is formed to include an edge that defines an opening to the tube and each of the plurality tabs is adapted to couple to the tube adjacent to the edge.

32. The noise attenuator of claim 28, wherein the plurality of tabs comprises two tabs.

33. The noise attenuator of claim 28, wherein the central regions of the plurality of tabs are coupled together.

34. The noise attenuator of claim 28, wherein the central regions of the tabs are arcuate.

35. The noise attenuator of claim 34, wherein the first surfaces of the plurality of tabs are convex and face toward the inlet end of the tube and the second surfaces are concave and face toward the outlet end of the tube.

36. The noise attenuation system of claim 28, further comprising a muffler housing formed to include an interior region, a muffler inlet into the interior region, and the inlet end of the tube is coupled to the muffler inlet and positioned to lie in the interior region to cause exhaust product flowing into the interior region through the muffler inlet to pass through the tube to intercept the acoustic reflector positioned to lie therein.

37. The noise attenuation system of claim 28, further comprising a catalytic converter housing formed to include an interior region and a converter inlet into the interior region and wherein the outlet end of the tube is coupled to the converter inlet.

38. A method of attenuating noise in exhaust product flowing through an exhaust system tube, the method comprising the steps of providing a tube having an inlet end, an outlet end, and an inner surface, the inner surface defining a passageway through which the exhaust product flows, providing a tab having a first end, a second end, a central region connecting the first and second ends, a first surface, and a second surface, the first surface being convex, and the second surface being concave, and coupling the tab to the tube so that the tab extends across the passageway, the first surface facing generally obliquely toward the inlet end, and the second surface facing toward the outlet end.

39. The method of claim 38, wherein the passageway has a longitudinal axis and a cross-sectional area perpendicular to the longitudinal axis and the tab occludes between about thirty percent and about fifty percent of the cross-section area of the passageway.

40. The method of claim 38, wherein the step of providing a tab comprises providing a tab formed from a thin metal strip.

41. The method of claim 38, wherein the tube has an edge defining an opening to the passageway and the step of coupling the tab to the tube comprises coupling the first end of the tab to a first location on the edge and coupling the second end of the tab to a second location on the edge spaced apart from the first location.

42. The method of claim 38, wherein the step of providing a tab comprises providing a tab including an arcuate central region.

43. The method of claim 38, further comprising the steps of providing a muffler housing formed to include an interior region and a muffler inlet into the interior region, an coupling the inlet end of the tube to the muffler inlet so that the tube is positioned to lie in the interior region and exhaust product flowing into the interior region through the muffler inlet to passes through the tube to intercept the acoustic reflector positioned to lie therein.

44. The method of claim 38, further comprising the steps of providing a catalytic converter housing formed to include an interior region and a converter inlet into the interior region, and coupling the outlet end of the tube to the converter inlet.

45. The noise attenuation system of claim 38, wherein the passageway includes a longitudinal axis and a cross-sectional area perpendicular to the longitudinal axis and the tab occludes less than about fifty percent of the cross-sectional area of the passageway.

46. A noise attenuation system for use in attenuating noise in exhaust product flowing through an exhaust system, the noise attenuation system comprising a tube having an inlet end, an outlet end, and an inner surface defining a passageway through which the exhaust product flows, and an acoustic reflector attached to the tube, the acoustic reflector including a tab extending across the passageway, the tab having a first surface, a second surface, a first end attached to the tube at a first location, a second end attached to the tube at a second location, and a central region between the first and second ends, the first surface facing generally obliquely toward the inlet end of the tube, and the tab being formed so that at least a portion of the central region is positioned in the passageway between the inlet end of the tube and the first location.

47. The noise attenuator of claim 46, wherein the central region includes two central sections and a ridge and the two central sections are joined at the ridge to form a V-shape.

48. The noise attenuator of claim 47, wherein the ridge is positioned to lie in the passageway between the inlet end of the tube and the two central sections.

* * * * *